United States Patent [19]

Sprunt

[11] Patent Number: 4,785,882

[45] Date of Patent: Nov. 22, 1988

[54] ENHANCED HYDROCARBON RECOVERY

[75] Inventor: Eve S. Sprunt, Farmers Branch, Tex.

[73] Assignee: Mobil Oil Corporation, New York, N.Y.

[21] Appl. No.: 66,803

[22] Filed: Jun. 24, 1987

[51] Int. Cl.[4] ..... E21B 43/16; E21B 49/00

[52] U.S. Cl. ..... 166/252; 166/268; 166/271

[58] Field of Search ..... 166/252, 259, 263, 268, 166/271, 307, 308; 299/4

[56] References Cited

U.S. PATENT DOCUMENTS

| | | | |
|---|---|---|---|
| 2,137,167 | 11/1938 | Lang | 166/268 X |
| 3,179,166 | 4/1965 | Sharp | 166/252 X |
| 3,209,824 | 10/1965 | Koch, Jr. et al. | 166/268 |
| 3,455,383 | 7/1969 | Prats et al. | 299/4 X |
| 3,980,339 | 9/1976 | Heald et al. | 299/4 X |
| 4,015,664 | 4/1977 | Acheson et al. | 166/259 |
| 4,091,869 | 5/1978 | Hoyer | 166/259 |
| 4,509,596 | 4/1985 | Emery | 166/268 X |
| 4,548,267 | 10/1985 | Sheffield et al. | 166/268 |
| 4,688,238 | 8/1987 | Sprunt et al. | 378/4 |

*Primary Examiner*—George A. Suchfield

*Attorney, Agent, or Firm*—Alexander J. McKillop; Michael G. Gilman; George W. Hager, Jr.

[57] ABSTRACT

Hydrocarbons are produced from a subterranean reservoir by maintaining the effective reservoir pressure below the reservoir crushing pressure during a first production period, causing the effective reservoir pressure to exceed the reservoir crushing pressure after such first production period so as to crush the reservoir and reduce the reservoir permeability, and then producing hydrocarbons from the reservoir during a second production period in which hydrocarbon production is enhanced due to better sweep efficiency as a result of the lowered permeability of the reservoir.

6 Claims, 2 Drawing Sheets

ENHANCED HYDROCARBON RECOVERY

BACKGROUND OF THE INVENTION

The present invention relates to the production of hydrocarbons from a subterranean reservoir and more particularly to the enhanced recovery of hydrocarbons by a change in reservoir permeability through controlled reservoir crushing.

It is well known in the oil industry that enhanced recovery techniques are employed to produce additional volumes of hydrocarbons from subterranean reservoirs after production by primary recovery techniques have declined to an uneconomical level. Primary recovery techniques include natural flow, gas lifting and pumping methods. There are hydrocarbon-bearing reservoirs, which even though containing large quantities of hydrocarbon, are incapable of being produced by primary recovery techniques. Recognition of the large amount of residual hydrocarbon in many reservoirs has led to the use of the so-called enhanced, or secondary, recovery techniques which have as their purpose the economical recovery of additional quantities of the residual hydrocarbon known to be present in the reservoir. In those enhanced recovery techniques, means is introduced into the reservoir to displace hydrocarbons therein to a suitable production system through which the hydrocarbons may be withdrawn to the surface of the earth. One commonly known secondary recovery technique involves injecting fluid, such as a gas, into a partially depleted reservoir through an injection system to drive hydrocarbons toward a production system from which the hydrocarbons are produced along with portions of the driving fluid. When the ratio of driving fluid to hydrocarbons reaches an uneconomical level, the reservoir is normally abandoned, even though a substantial amount of residual hydrocarbons still remains in the reservoir.

In general, large quantities of fluid are employed in such processes because pressures in the thousands of psig are normally employed. Often incremental hydrocarbon recovery due to the enhanced recovery is not as great as is desired because of the existence of rather wide variations in the permeability of various portions of such formations. The injected driving fluid tends to follow selective paths through the relatively more permeable channels of the formation from the injection well to the production well. Because of this channeling tendency, the driving fluid fails to contact the portions of the hydrocarbons that reside in the relatively less permeable portions of the formation. The sweep efficiency of the operation, as a result, is relatively poor. Because of this poor sweep efficiency, a large portion of the recoverable hydrocarbons in the reservoir is bypassed, seriously limiting the overall effectiveness and efficiency of the recovery operation.

Even when the reservoir exhibits a relatively uniform permeability throughout, a situation referred to as instability channeling may develop in those instances where the viscosity of the injected displacing fluid is signficantly less than the viscosity of the in-situ reservoir hydrocarbons. In this situation, the less viscous displacing fluid tends to develop channels or fingers which may be caused by points of minute heterogeneities in the reservoir. These channels of displacing fluid tend to become extended in the direction of flow and travel at a faster rate than the remainder of the injected fluid, thus again resulting in poor sweep efficiency.

It is, therefore, an object of the present invention to enhance the sweep efficiency of an injected fluid during hydrocarbon recovery from a subterranean reservoir by altering the permeability of the reservoir through a controlled in-situ reservoir crushing technique.

SUMMARY OF THE INVENTION

In accorance with the present invention there is provided an enhanced hydrocarbon recovery method for a subterranean reservoir, relating to the change of reservoir permeability through controlled reservoir crushing.

More particularly, a determination is made of the in-situ crushing pressure of the subterranean reservoir which is to be produced for hydrocarbons. Hydrocarbons are initially produced from the reservoir while maintaining reservoir fluid pressure so that the effective pressure on the reservoir from the pressures of the overlying formation and the reservoir fluid is less than the determined reservoir crushing pressure. Such reservoir fluid pressure may be maintained thru selective gas injection as the reservoir is depleted of hydrocarbons during production. Thereafter, the reservoir fluid pressure is adjusted, or lowered, by further control of gas injection to allow the effective pressure on the reservoir to exceed the the resulting lowering of reservoir permeability, particularly with respect to the more permeable channeling paths within the reservoir. Hydrocarbons are then again produced from the reservoir with enhanced sweep efficiency due to the lowered permeability. The hydrocarbon productions both before and after reservoir crushing may be continued until such time as there is injection gas breakthrough along with the produced hydrocarbons, or until hydrocarbon production becomes uneconomical. The formation may also contain a number of strata that crush at different pressures. Cycling of the foregoing steps of the invention may be repeated a plurality of times as desired. Pressure maintenance can be reduced stepwise so that strata with different crushing strengths do not all crush simultaneously. In each cycle of the foregoing steps different strata can be allowed to crush as controlled by the pressure maintenance.

DESCRIPTION OF THE PREFERRED EMBODIMENT

Figure 1:
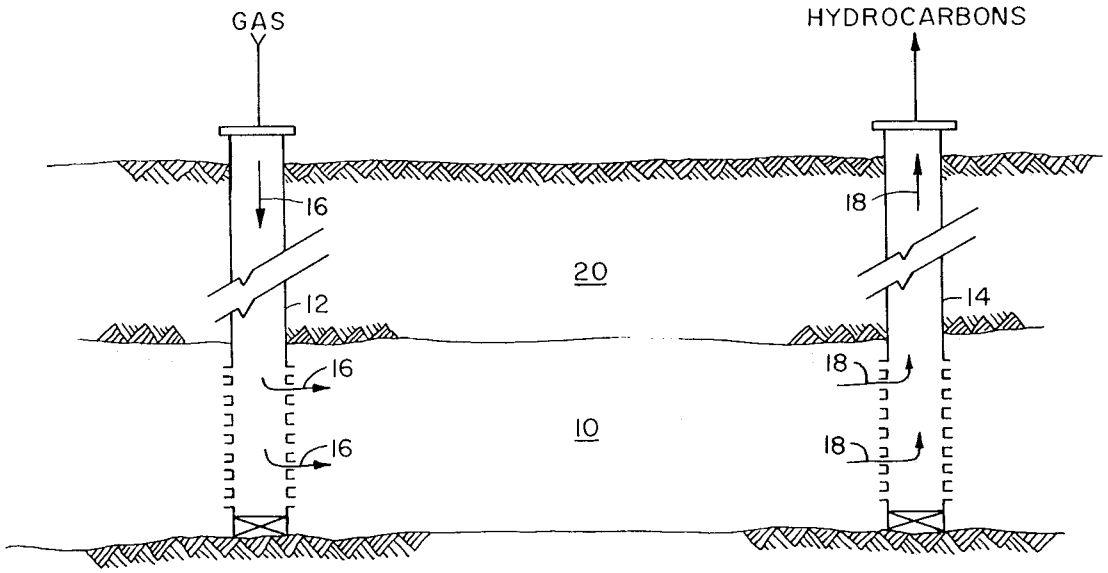
FIG. 1 illustrates a hydrocarbon reservoir production system, including separate injection and production wells, with which the method of the present invention may be carried out.

Referring to FIG. 1, a subterranean hydrocarbon bearing formation 10 is penetrated by at least one injection well 12 and at least one spaced-apart production well 14. Both the injection well 12 and the production well 14 are perforated to establish fluid communication with a substantial portion of the hydrocarbon bearing formation 10.

The first step in the process of the present invention, after primary hydrocarbon recovery becomes uneconomical through production well 14 by conventional pumping or lifting means, is to determine the in-situ crushing pressure of the formation 10. Several conventional methods are available and may be employed for making such determination. One such method is described in U.S. Pat. No. 4,688,238, filed May 30, 1986, to Sprunt et al, the teaching of which is incorporated herein by reference. Briefly however, a core sample from a subterranean reservoir is placed in a confining pressure cell. Pressure in the cell is raised over a plurality of pressure points. The core sample is scanned at a plurality of locations with X-rays at each of the pressure points. Computed tomographic images of the sample are produced for each of the X-ray scans. The crushing pressure is identified from said images as that pressure at which the permeable channels within the core sample are altered, or destroyed, so as to result in a permeability change.

The next step of the invention is to maintain reservoir pressure so that the effective pressure on the reservoir 10 is less than the identified crushing pressure. This effective depends on the pressure due to the overlying formation 20 and the fluid pressure with the reservoir 10. During hydrocarbon production, the reservoir fluid pressure will tend to decrease, thereby increasing the effective pressure on the reservoir. To prevent this increase in effective pressure from reaching the reservoir crushing pressure, the reservoir fluid pressure is maintained by injecting a gas, such as nitrogen or a lean hydrocarbon gas, for example, through injection well 12, as shown by arrows 16, and out into the reservoir 10. While continuing to maintain reservoir pressure through such gas injection, hydrocarbon production is continued, as shown by arrows 18, until it again becomes uneconomical, or until there is breakthrough of the injection gas at production well 14.

At this point in the process, the reservoir permeability is decreased through reduction of the above described gas injection through injection well 12, as shown by arrows 16, to lower the reservoir pressure to allow the effective pressure on the reservoir 10 to exceed the reservoir crushing pressure. As the reservoir begins to crush, the more permeable channels in the reservoir are eliminated. Following crushing of the more permeable flow channels, the reservoir is again produced until there is breakthrough of injection gas at the production well, or until hydrocarbon production becomes uneconomical. If further production is desired at this point, the reservoir pressure may be further adjusted to cause additional reservoir crushing. The additional crushing further lowers reservoir permeability, thereby enhancing the sweep efficiency of the injection gas through the reservoir.

Figure 2:
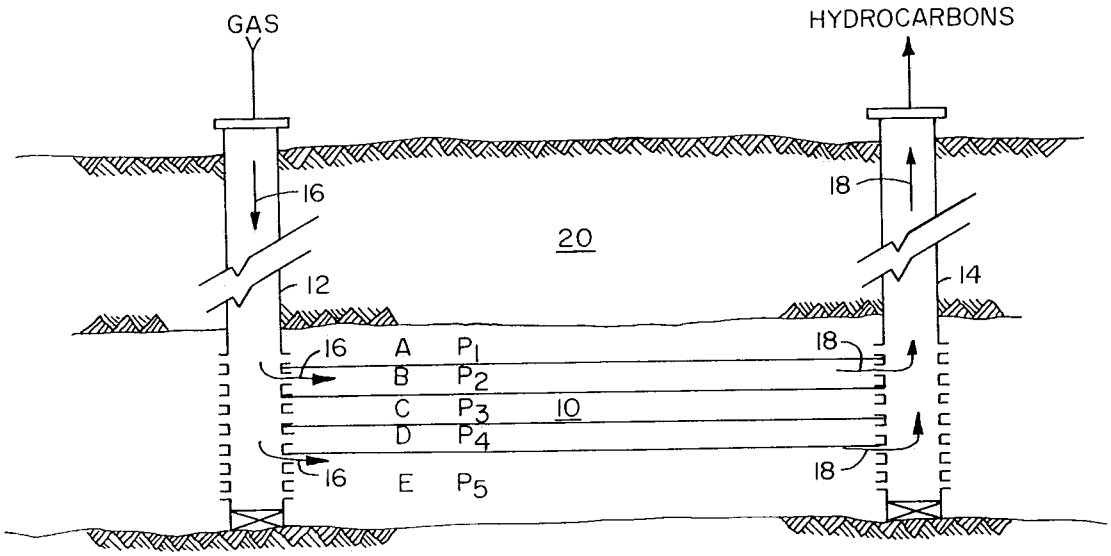
FIG. 2 illustrates a hydrocarbon reservoir production system as in FIG. 1, but with the producing formation divided into different strata with different crushing pressure, Pi.

Referring to FIG. 2, a subterranean hydrocarbon formation is divided into different strata (A,B,C,D,E) with different crushing pressures ($P_1$, $P_2$, $P_3$, $P_4$, $P_5$), respectively. The pressure is dropped stepwise, separated with intervals of production.

One use of the reservoir pressure maintenance technique of the present invention to control reservoir permeability through reservoir crushing would be in a gas condensate reservoir with polymodal permeability. Gas condensate reservoirs produce substantial amounts of liquid hydrocarbons along with gaseous hydrocarbons. One example would be a gas condensate reservoir with bimodal permeabilities of 100–200 millidarcys and 2–20 millidarcys. If reservoir pressure were maintained to prevent condensate from coming out of solution with the gas, breakthrough would occur through the 100–200 millidarcy zones before the 2–20 millidarcy zones were swept. If reservoir pressure decrease necessary to produce crushing in the more permeable reservoir zones was less than the reservoir pressure decrease which causes condensate to come out of solution, controlled reservoir crushing would result in better hydrocarbon recovery from the less permeable reservoir zones.

While a preferred embodiment of the present invention has been described, numerous modifications and alterations may be made without departing from the spirit and scope of the invention as set forth in the appended claims.

I claim:

1. A method for enhanced hydrocarbon recovery from a subterranean reservoir, comprising the steps of:

(a) determining the in-situ crushing pressure of the subterranean hydrocarbon reservoir to be produced, (b) producing hydrocarbons from the reservoir during a first production period while injecting gas into said reservoir to maintain reservoir fluid pressure so that the effective pressure on the reservoir from the pressure of the overling formation and the reservoir fluid is less than the determined reservoir crushing pressure, (c) lowering reservoir fluid pressure by reducing gas injection following said first production period to allow the effective pressure on the reservoir to exceed the reservoir crushing pressure such that said reservoir crushes with a resulting lowering of reservoir permeability, and (d) producing hydrocarbons from the reservoir during a second production period following the lowering of reservoir permeability.

2. The method of claim 1 further comprising the step of terminating said first and second production periods when there is injection gas breakthrough with the hydrocarbons being produced.

3. The method of claim 1 further comprising the step of repeating steps (b)–(d) in sequence a plurality of times.

4. A method for enhanced hydrocarbon recovery from a subterranean reservoir, comprising the steps of:

(a) injecting gas into said reservoir to maintain the pressure on the reservoir below the reservoir crushing pressure, (b) producing hydrocarbons from said reservoir during a first production period, (c) reducing gas injection into said reservoir to cause the pressure on the reservoir to exceed the reservoir crushing pressure after said first production period so as to crush the reservoir and lower the reservoir permeability, and (d) producing hydrocarbons from said reservoir during a second production period in which hydrocarbon production is enhanced due to said lowered reservoir permeability.

5. The method of claim 4 further comprising the step of reducing the pressure on the reservoir in step (c) to cause a crushing of the reservoir which eliminates permeability attributable to fluid channeling within the reservoir.

6. A method for enhanced hydrocarbon recovery from a subterranean reservoir having a plurality of stratas with differing crushing pressures, comprising the steps of:

(a) determining the in-situ crushing pressure of each of said reservoir strata, (b) producing hydrocarbons from the reservoir during a first production period while maintaining reservoir fluid pressure by injecting gas into said reservoir so that the effective pressure on the reservoir from the pressures of the overlying formation and the reservoir fluid is less than the lowest of the reservoir strata crushing pressures, (c) lowering the reservoir fluid pressure by reducing gas injection in sequential steps to allow the effective pressure on the reservoir during each of said sequential steps to exceed one of the differing crushing pressure of said plurality of reservoir stratas and cause sequential crushing of said stratas, and (d) producing hydrocarbons from the reservoir following each of the sequential strata crushings in step c.

* * * * *